US006592440B2

(12) United States Patent
Mueller

(10) Patent No.: US 6,592,440 B2
(45) Date of Patent: Jul. 15, 2003

(54) HAND BAND GRINDER WITH SIDE ABUTMENT

(75) Inventor: Otto Mueller, Stuttgart-Plieningen (DE)

(73) Assignee: Robert Bosch GmbH, Stuttgart (DE)

( * ) Notice: Subject to any disclaimer, the term of this patent is extended or adjusted under 35 U.S.C. 154(b) by 21 days.

(21) Appl. No.: 09/748,407

(22) Filed: Dec. 26, 2000

(65) Prior Publication Data

US 2001/0036802 A1 Nov. 1, 2001

(30) Foreign Application Priority Data

Dec. 28, 1999 (DE) ..... 299 22 880 U

(51) Int. Cl.[7] ..... B24B 23/00

(52) U.S. Cl. ..... 451/355; 451/354; 451/348; 451/344

(58) Field of Search ..... 451/355, 354, 451/348, 344

(56) References Cited

U.S. PATENT DOCUMENTS

| | | | |
|---|---|---|---|
| 3,828,484 A | | 8/1974 | Baechle |
| 4,334,390 A | * | 6/1982 | Sumerau |
| 6,174,226 B1 | * | 1/2001 | Frech et al. |

FOREIGN PATENT DOCUMENTS

| | | |
|---|---|---|
| EP | 0 027 219 A1 | 4/1981 |
| GB | 1137638 | 12/1968 |

* cited by examiner

*Primary Examiner*—Joseph J. Hail, III
*Assistant Examiner*—Willie Berry, Jr.
(74) *Attorney, Agent, or Firm*—Michael J. Striker

(57) ABSTRACT

A motor-driven hand band grinder has a frame, a movable grinding band defining a grinding plane, and an abutment having a plate part which determines a further plane, the plate part having a window-shaped opening provided over an edge of the grinding band and forming a guiding handle.

11 Claims, 3 Drawing Sheets

HAND BAND GRINDER WITH SIDE ABUTMENT

BACKGROUND OF THE INVENTION

The present invention relates to a motor-operated hand band grinder with a side abutment.

The publication "Bosch-Heimwerkerprogramm, Katalog, 1999/2000", page 88, discloses a hand band grinder with an abutment part, having a plane which can be arranged perpendicular to a grinding plane of the hand band grinder. During grinding with this hand band grinder, it is practically not possible to recognize an edge of the grinding band. Thereby the treated grinding surface of a workpiece can not be observed. A control of the work is therefore possible very poorly.

A further disadvantage of the above mentioned hand band grinder is that the abutment has a very small length normal to the grinding plane. Thereby the grinding on vertical edges is uncomfortable, since by the weight of the hand band grinder and a very short lever for the machine user, a very high support force must be brought to guide the band perpendicular to a workpiece surface, on which the abutment is laid. This high supporting force leads to high friction forces between the abutment and the workpiece surface. The hand band grinder is thereby guided along only with a significant force application to the grinding surface. This high force application leads under certain conditions to an undesirably high material removal.

Moreover, the abutment is not provided for a mobile use, but instead for a stationary utilization and thereby is less comfortable. Furthermore, the above mentioned abutment has no connection to a suction device, so that the grinding dust can be removed only by a machine-side suction device at the hand band grinder.

SUMMARY OF THE INVENTION

Accordingly, it is an object of the present invention to provide a hand band grinder which avoids the disadvantages of the prior art.

In keeping with these objects and with others which will become apparent hereinafter, one feature of present invention resides, briefly stated, in a hand band grinder in which the plate part has a window-shaped opening over an edge of the grinding band and forms a guiding handle.

When the hand band grinder is designed in accordance with the present invention, the user can see an edge of the grinding band through the window-shaped opening. With an arcuate design of the plate part, additionally to the openings, a torsion-resistant connection of the plate part to a folding part of the abutment is obtained.

The arcuate plate part can be formed as a semi-ring. It has a central point located in the region of the grinding plane. Thereby a good operational property for the user are provided, since the plate part has a handle projecting substantially uniformly to the grinding plane, regardless of what position the hand band grinder together with the abutment part assumes to the workpiece.

In accordance with an advantageous embodiment of the present invention, the plate part is formed so that its abutment region is engageable by the hand of the user.

Another advantage of the invention is provided when the greatest distance of the plate part from the grinding plate is such as the distance of the handle of the hand band grinder from the grinding plate. This has the advantage that thereby a longer lever is formed during support of the user on the arcuate plate part and a specially high supporting moment is produced. The hand band grinder can be held with low supporting force on the grinding edge to be treated. The body of the user is therefore unloaded and he can concentrate on the grinding process.

For providing a reliable connection between the abutment part and the hand band grinder, it is advantageous when in accordance with the present invention a mounting is performed by at least one mounting part. For mounting the abutment part on the hand a grinder it is especially advantageous when the already available receptacle for a stationary device can be used for the mounting.

An especially efficient suction of the grinding dust is performed when in accordance with the present invention the abutment part at the location where the grinding band again enters in the machine has a dust throughgoing opening with a connection to a suction device.

In order to provide a fine treatment of the workpiece, it is advantageous when in accordance with the present invention the side of the plate part which faces the workpiece has a workpiece-refining coating which advantageously can be additionally dismountable.

It is also advantageous when in accordance with the present invention the plate part of the abutment is adjustable turnably to the grinding plane. Thereby different micro-grinding angles can be adjusted between the surface to be ground and the workpiece surface on which the abutment part is guided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
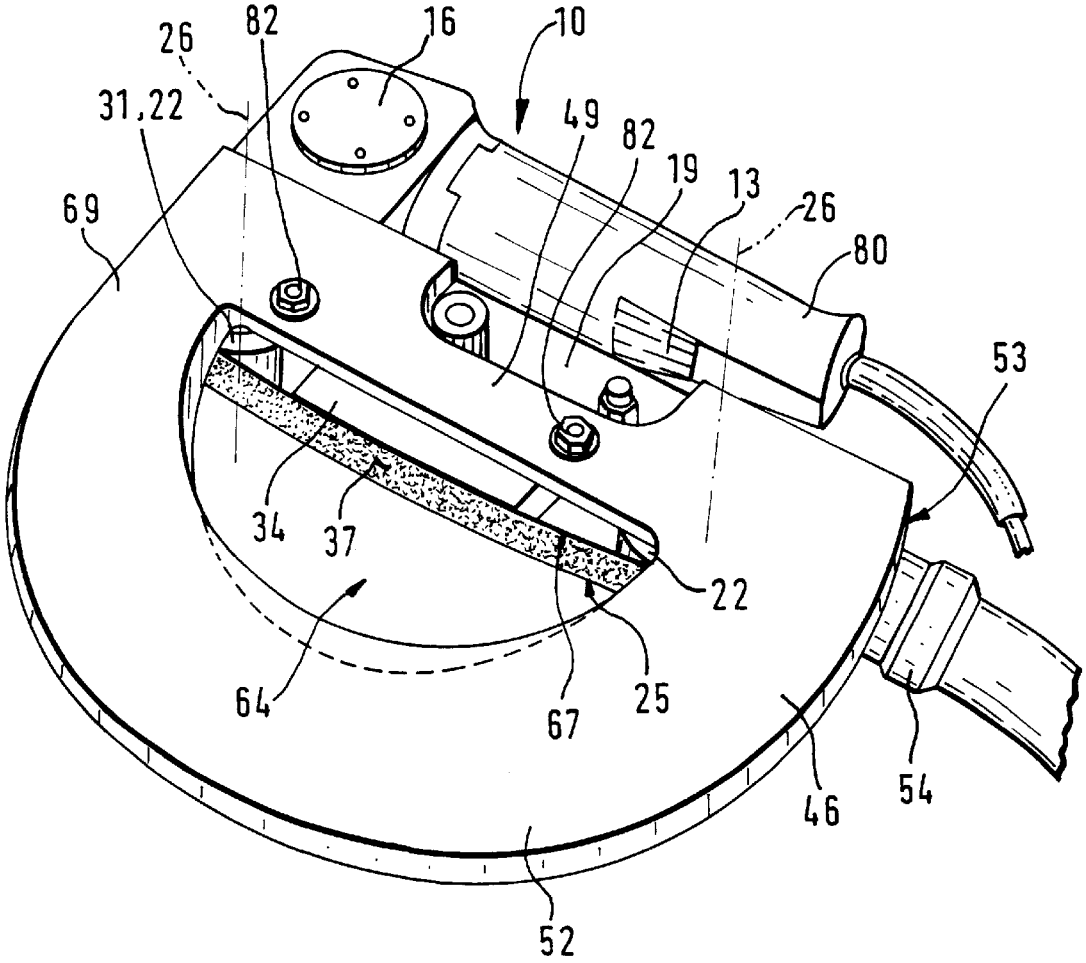
FIG. 1 is a plan view of a hand band grinder with an abutment part in accordance with the present invention.

A hand band grinder shown in FIG. 1 is identified as a whole with reference numeral 10. It has a drive motor 13 which is flanged on a transmission housing 16. The transmission housing 16 is connected with a frame 19 which carries two deviating rollers 22 for guiding a ring-shaped grinding band 25. Both deviating rollers 22 have axes 26 extending parallel to one another. The drive motor 13 drives a drive roller 31 through a transmission which is arranged in the transmission housing 16. The drive roller 31 in this case is identical with one of the both deviating rollers 22. The grinding band 25 runs over a grinding plate 34 arranged between the deviating rollers 22 and located in a grinding plane 37. The grinding plane 37 is associated with a surface of a workpiece 43 to be grinded.

Figure 2:
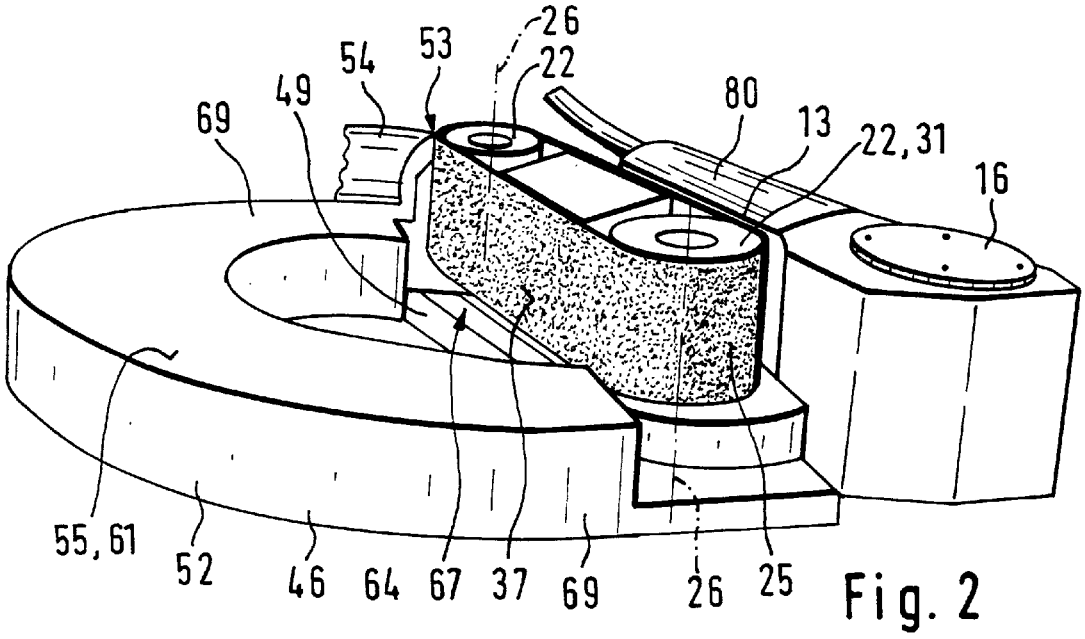
FIG. 2 is a view showing an end side of the hand band grinder with the abutment part.

An abutment 46 is mounted on the hand band grinder 10. It has a holding part 49 and a plate part 52. The holding part 49 serves for holding of the abutment 46 on the housing, or on the frame 19, of the hand band grinder 10. The plate part 52 which is connected with the holding part 49 of one piece with one another serves for orienting the hand band grinder 10 relative to the workpiece 43. At a location where the grinding band 25 again enters the frame 19, the abutment part 45 has a connection 53 for a suction device 54 The connection can be formed for example as a suction through-going opening. The plate part 52 has a lower side 55 which is placeable on a workplace surface 58 of the workpiece 43 as shown in FIG. 2. The lower side 55 determines a plane 61 which is arranged perpendicular to the grinding plane 37.

As can be seen from FIGS. 1 and 2, the plate part 52 has a window-shaped opening 64. An edge 67 of the grinding band 25 is visible through the opening 64 during the grinding. The window-shaped opening 64 is thereby arranged over the edge 67.

The plate part 52 Is formed arcuately as a wide semi-ring. It is connected with the holding part 49 by two legs 69. The plate part 52 has a substantially rectangular profile 70 with an abutment 46 which is engageable 1 mm above by fingers of the operator shown in FIG. 3, so that the hand band grinder 10 with the abutment 46 is easy to guide. The weight of the hand band grinder 10 with the abutment 46 can be at least partially compensated in that, the greatest distance 76 of the plate part 52 from the grinding plane 37 substantially corresponds to the height 79 of the hand band grinder 10. It provides thereby a favorable lever action.

As can be seen from FIG. 1, the height 79 of the hand band grinder 10 is determined as a distance between the grinding plate 37 and its handle 80. With a symmetrical dimensioning of the plate part 52, whose distance 76 to the grinding plane corresponds to the height 79, a favorable lever action is obtained. With the great distance 76, in turn the supporting force applied by the user of the machine is low and thereby the operation of the hand band grinder 10 is simplified.

The abutment 46 is mounted on the hand band grinder 10 with two mounting elements 82. In the shown embodiment, the mounting elements 82 are formed as screws which are arranged parallel to the axes of the deviating rollers 22.

Figure 3:
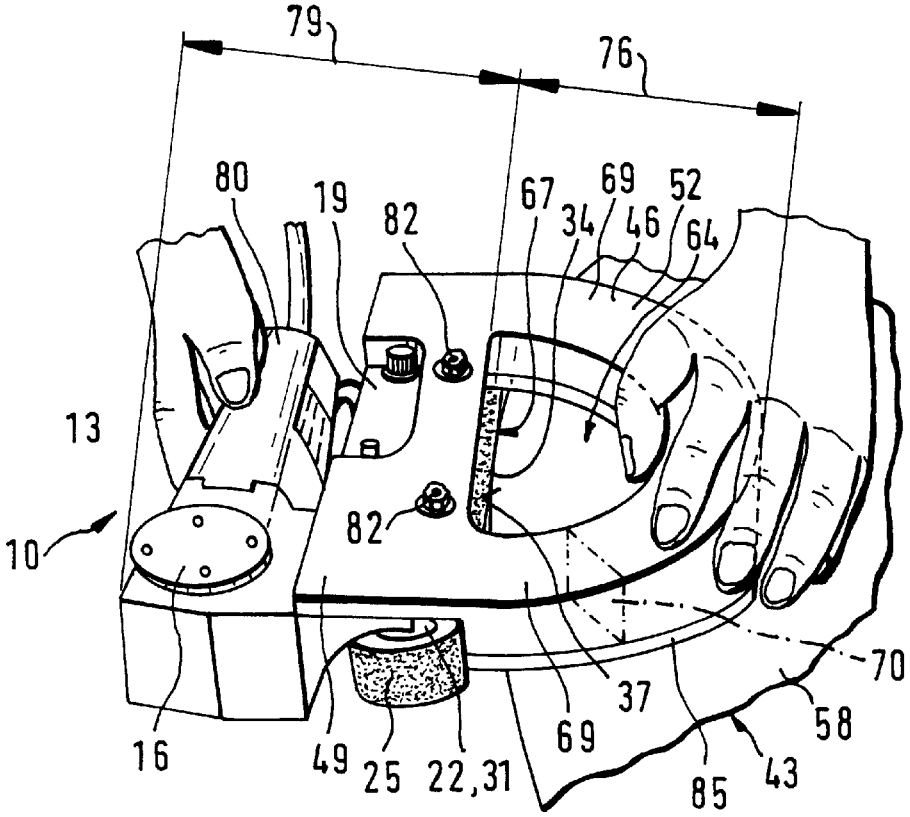
FIG. 3 is a plan view of the hand band grinder with an abutment part in a working position.

FIG. 3 shows a variant of the plate part 52 with the hand band grinder 10. The lower side 55 of the plate part 52 is provided with a coating 85 composed of a material which is softer than the plate part 52. In order to refine the workpiece surface 58 during placing of the plate part 52, the coating 85 can be formed, for example, as a cushion which is dismountably connected to the plate part 52 by a burdock connection. The coating 85 determines with the side facing away from the plate part 52, a plane 61 which is perpendicular to the grinding plane 37.

Figure 4:
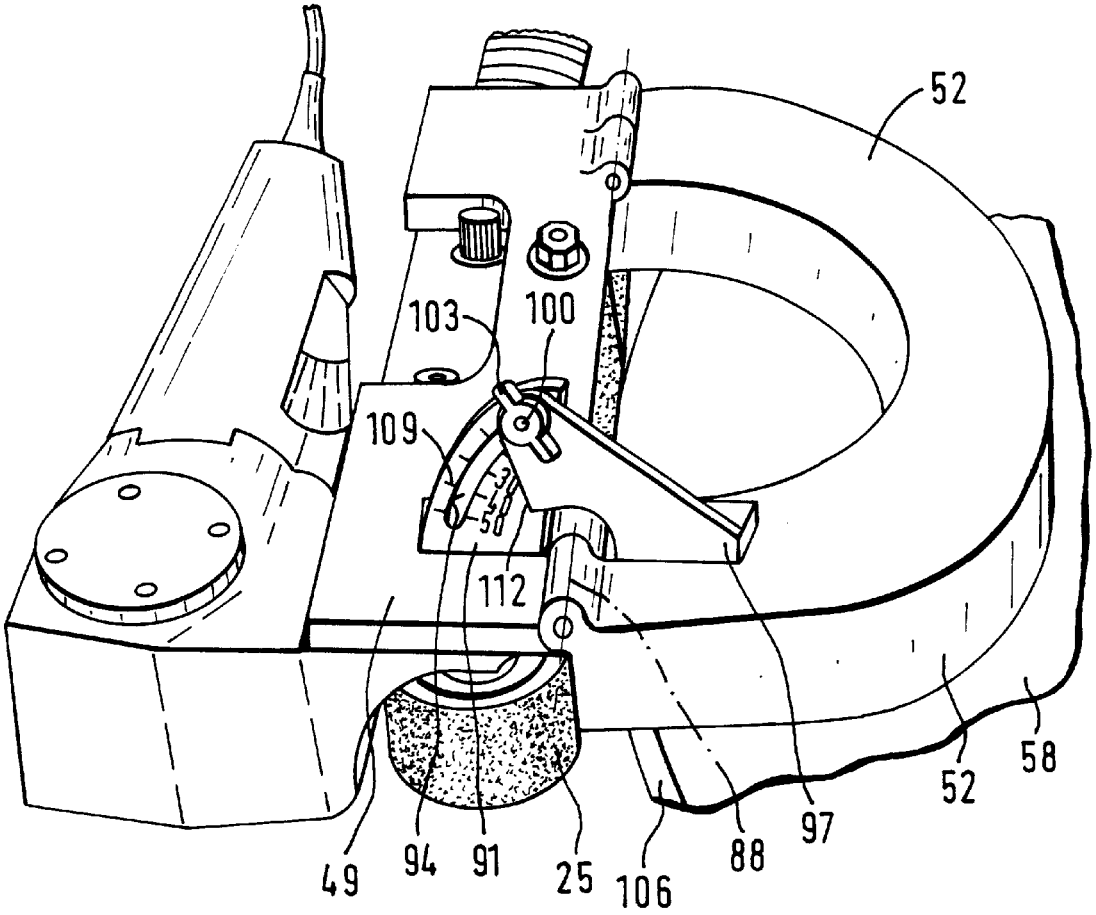
FIG. 4 is a view showing a second embodiment of the inventive hand band grinder, with a turnable plate part of the abutment part.

In accordance with a second embodiment of the abutment 46, the plate part 52 is turnably adjustable around a turning axis 88 and it is correspondingly arrestable. This embodiment is shown in FIG. 4. Here the turning axis 88 extends parallel to the edge 67 of the grinding band 25.

A coulisse element 91 is mounted in the holding part 49. The coulisse element 91 has a coulisse guide 94. It has a circular-ring shape with a central point located on the turning axis 88. An arresting part 97 is mounted on the plate part 52. It has an opening through which a pin-shaped arresting member 100 is pluggable. The arresting member 100 extends outwardly beyond the coulisse guide 94.

With a wing nut 103 which cooperates with the arresting member 100, a miter grinding angle between the workpiece surface 58 and a surface 106 to be grinded is adjustable. Adjustable angles are readable on the coulisse element 91 on a scale 109 or a pointer edge 112.

It will be understood that each of the elements described above, or two or more together, may also find a useful application in other types of constructions differing from the types described above.

While the invention has been illustrated and described as embodied in hand band grinder with side abutment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claim is:

1. A motor-driven hand band grinder, comprising a frame; a movable grinding band defining a grinding plane, and an abutment having a plate part which determines a further plane, said plate part having a window-shaped opening provided directly next to an edge of said grinding band and forming a guiding handle, and wherein said grinding band is observable and controllable through said window-shaped opening.

2. A motor-driven hand band grinder as defined in claim 1, wherein said plate part is arcuate, said abutment further having a holding part which is connected with said plate part.

3. A motor-driven hand band grinder as defined in claim 2, wherein said arcuate plate part has a shape of a circular arc.

4. A motor-driven hand band grinder as defined in claim 1, wherein a greatest distance of said plate part from said grinding plane substantially corresponds to a height of the hand band grinder.

5. A motor-driven hand band grinder as defined in claim 1; and further comprising a mounting means for mounting said abutment part.

6. A motor-driven hand band grinder as defined in claim 1; and further comprising a receptacle for a stationary device, said abutment part being mountable on said receptacle.

7. A motor-driven hand band grinder as defined in claim 1, wherein said connection is formed as a dust passage opening.

8. A motor-driven hand band grinder as defined in claim 1, wherein said plate part has a coating with a side which faces away from said plate part and forms said further plane.

9. A motor-driven hand band grinder as defined in claim 1, wherein said plate part is turnable about a turning axis and is arrestable so as to adjust a miter grinding angle between a workpiece surface and a surface to be grinded.

10. A motor-driven hand band grinder, comprising a frame; a movable grinding band defining a grinding plane, and an abutment having a plate part which determines a further plane, said plate part having a window-shaped opening provided over an edge of said grinding band and forming a guiding handle, wherein said plate part is adapted to be placed on a workpiece and has a profile with a placing region engageable by fingers of an operator's hand.

11. A motor-driven hand band grinder, comprising a frame; a movable grinding band defining a grinding plane, and an abutment having a plate part which determines a further plane, said plate part having a coating and a window-shaped opening provided over an edge of said grinding band and forming a guiding handle, wherein said coating has a material which provides a refining of a workpiece surface.

* * * * *